United States Patent [19]

Shook

[11] Patent Number: 5,036,903

[45] Date of Patent: Aug. 6, 1991

[54] GRAPHITE TUBE CONDENSING HEAT EXCHANGER AND METHOD OF OPERATING SAME

[75] Inventor: James R. Shook, Pickerington, Ohio

[73] Assignee: United McGill Corporation, Groveport, Ohio

[21] Appl. No.: 433,590

[22] Filed: Nov. 8, 1989

[51] Int. Cl.[5] ..... F28F 19/02

[52] U.S. Cl. ..... 165/1; 165/111; 165/133; 165/905; 165/921

[58] Field of Search ..... 165/111, 133, 905, 913, 165/921, 1; 285/236

[56] References Cited

U.S. PATENT DOCUMENTS

| | | | |
|---|---|---|---|
| 2,726,682 | 12/1955 | Connoy et al. | 285/236 |
| 2,838,287 | 6/1958 | Kuhner | 165/921 X |
| 3,265,124 | 8/1966 | Reys | 165/133 |
| 3,759,445 | 9/1973 | King | 239/201 |
| 4,059,293 | 11/1977 | Sipler | 285/236 |
| 4,380,348 | 4/1983 | Swartz | 285/236 |
| 4,437,217 | 3/1984 | Lallaye et al. | 29/157.4 |
| 4,488,342 | 12/1984 | Daugiorda | 29/157.3 R |
| 4,669,530 | 6/1987 | Warner | 165/1 |

*Primary Examiner*—Allen J. Flanigan

*Attorney, Agent, or Firm*—Mueller and Smith

[57] ABSTRACT

The present invention is directed to a method for recovering heat from a gas stream contaminated with water vapor and an acid-forming moiety, said gas having an acid dew point ranging from about 200° F. to 300° F. and a water dew point ranging from about 90.20 F. to 150° F. The inventive method comprises passing the gas stream through a heat exchange fitted with a plurality of generally-parallel tubes through which flow heat exchanging fluid counter-current to the flow of said gas stream in said heat exchanger. The heat exchanging fluid is at a temperature such that the exterior tube temperature is at or below both said dew points, or the temperature of the contaminated gas stream exiting the heat exchanger is at or below both said dew points. The tubes are formed from acid-resistant, resin-impregnated graphite and exhibit a smooth, washable exterior surface. The heat exchanger further is fitted with a pair of side apertured tube sheets through which said tubes penetrate. The ends of the tubes penetrating through the tube sheets are interconnected with non-graphite connectors for establishing a flow path of heat exchange fluid therethrough. The tube sheets house an interior heat-exchange chamber therebetween through which said contaminated gas stream flows.

19 Claims, 2 Drawing Sheets

GRAPHITE TUBE CONDENSING HEAT EXCHANGER AND METHOD OF OPERATING SAME

BACKGROUND OF THE INVENTION

The present invention relates to the recovery of heat from a gas stream contaminated with water vapor and an acid-forming moiety, and more particularly to a heat exchanger adapted therefor.

In many applications, it is desirable that waste heat from an exhaust gas be used to preheat boiler make-up water, boiler air, or other process fluid. When the exhaust gas is contaminated with water vapor and an acid/acid-forming moiety, such as flue gas, significant problems can develop during the heat recovery operation. Initially, the waste heat typically is recovered by passing the gas stream through a heat exchanger fitted with a plurality of generally parallel tubes through which heat exchanging fluid, e.g. water or air, flow. The art has recognized that the flue gas can be cooled condensed to a temperature above the acid dew point without endangering the internal components of the heat exchanger. Such an operation, however, recovers only a fraction of the available heat from such flue gas waste stream.

In order to recover substantially all of the economically-recoverable heat value in flue gas, the art has devised condensing economizer heat exchangers. Such heat exchangers can be found in the following U.S. Pat. Nos.: 4,738,310, 4,487,139, 4,526,112, 4,577,380, 4,669,530, 4,776,391, 4,557,202, and 4,705,101. The '310 patent uses a glass tube heat exchanger wherein the apertured tube sheets retaining the glass tubes are lined with corrosion-resistant material. The interior volume of the heat exchanger, then, is sufficiently corrosion-resistant that condensed acid can be tolerated, especially since water spray provision for washing the tubes is a standard feature of such condensing economizers. The latter listed patents employ metal tubes that are coated with polytetrafluorethylene (Telflon brand fluoroplastic) in order to make the tubes corrosion-resistant. These patents also utilize multiple heat exchangers arranged in a variety of configurations.

With respect to the use of glass tubes, it will be appreciated that the thermal conductivity of glass is about 0.63 btu/hr-ft-°F. Polytetrafluoroethylene-coated metal tubes must utilize a thin coating (0.15 in.) as such fluoroplastics tend to be somewhat insulative at thicker coating levels, (0.040 in.) and the thinness of such coatings detracts from longevity of the coated tubes. State of the art in chemical processing equipment dictates that 0.040 in. minimum thickness of fluoroplastic is required for general corrosion protection. Thus, there is a need in the art to provide improved corrosion-resistant, durable tubes in condensing economizer heat exchangers.

BROAD STATEMENT OF THE INVENTION

The present invention is directed to a method for recovering heat from a gas stream contaminated with water vapor and an acid-forming moiety, said gas having an acid dew point ranging from about 200° F. to 300° F. and a water dew point ranging from about 90° F. to 150° F. The contaminated gas stream often is generated from a combustion process. The inventive method comprises passing the gas stream through a heat exchanger fitted with a plurality of generally-parallel tubes through which flow heat exchanging fluid counter-current to the flow of said gas stream in said heat exchanger. The heat exchanging fluid is at a temperature such that the exterior tube temperature is at or below both said dew points, or the temperature of the contaminated gas stream exiting the heat exchanger is at or below both said dew points. The tubes are formed from acid-resistant, resin-impregnated graphite and exhibit a smooth, washable exterior surface. The heat exchanger further is fitted with a pair of side apertured tube sheets through which said tubes penetrate. The ends of the tubes penetrating through the tube sheets are interconnected with non-graphite connectors for establishing a flow path of heat exchange fluid therethrough. The tube sheets house an interior heat-exchange chamber therebetween through which said contaminated gas stream flows.

Another aspect of the present invention is a corrosion-protection coating system for the side apertured tube sheets through which the graphite tubes penetrate. Such coating system comprises an inner silicon-carbide impregnated expoxidized novolak coating adherently affixed to the tube sheet and over which is a fiber-reinforced fluoroplastic layer.

As yet another aspect of the present invention is the connector system utilized to interconnect non-graphite connectors with the graphite tubes. In this aspect of the present invention, connectors, which preferably are U-shaped in configuration and made from stainless steel or the like, contain a bead about each end and are placed adjacent the ends of two different tubes penetrating through the apertured tube sheets. Each end of the graphite tubes has machined in a barbed fitting. An elastic sleeve is placed around the joining of the connector and tube and extends beyond the connector bead and tube Christmas tree fitting. The ends of the sleeve are clamped with a pair of clamps to provide a pressure fitting between two dissimilar materials that exhibit different coefficients of thermal expansion.

Advantages of the present invention include a heat exchanger tube system which possesses improved thermal conductivity characteristics, is inherently resistant to acid, and can be formed with a surface that can be readily washable. Another advantage is the ability to recover substantial amounts of heat from contaminated gas streams using a durable heat exchanger. A further advantage is a tube sheet corrosion-protection coating system of improved efficacy. These and other advantages will be readily apparent to those skilled based on the disclosure herein.

The drawings will be described in detail in connection with the following description of the invention.

DETAILED DESCRIPTION OF THE INVENTION

The basic construction and operation of a condensing economizer heat exchanger is known in the art, such as is illustrated in the patents cited above. The inventive heat recovery method and heat exchanger employ significant improvements in the heat exchanger tubes, interconnection of layers of tubes, and tube sheet protection, resulting in an improved heat exchanger and method for recovering heat from contaminated gas streams.

In this regard, contaminated gas streams are those that have been processed by condensing economizers in the art and are typified by flue gas resulting from the combusion of various fuel oils, natural gas, and coal. Such gas streams are contaminated with water vapor and an acid or acid-forming moiety, typified by various sulfur oxides, nitrogen oxides, and the like. Typical acids, or moieties that form such acids, include, for example, sulfuric acid, nitric acid, hydrochloric acid, carbonic acid, and hydrofluoric acid.

As recognized in the art, such contaminated gas streams typically have an acid dew point ranging from about 200° F. to 300° F. and a water dew point ranging from about 90° F. to 150° F. The "dew point" of the contaminated gas stream absent the acid/acid-forming moeity would be the water dew point, but is the acid dew point by virtue of the presence of such acid/acid-forming moeity, as is recognized in the art. It will be clear that such heat exchangers are known as "condensing" because water and acid are liquefied under conditions of operation. Such liquefication, however, causes substantial corrosion difficulties and greatly increases heat transfer.

Figure 1:
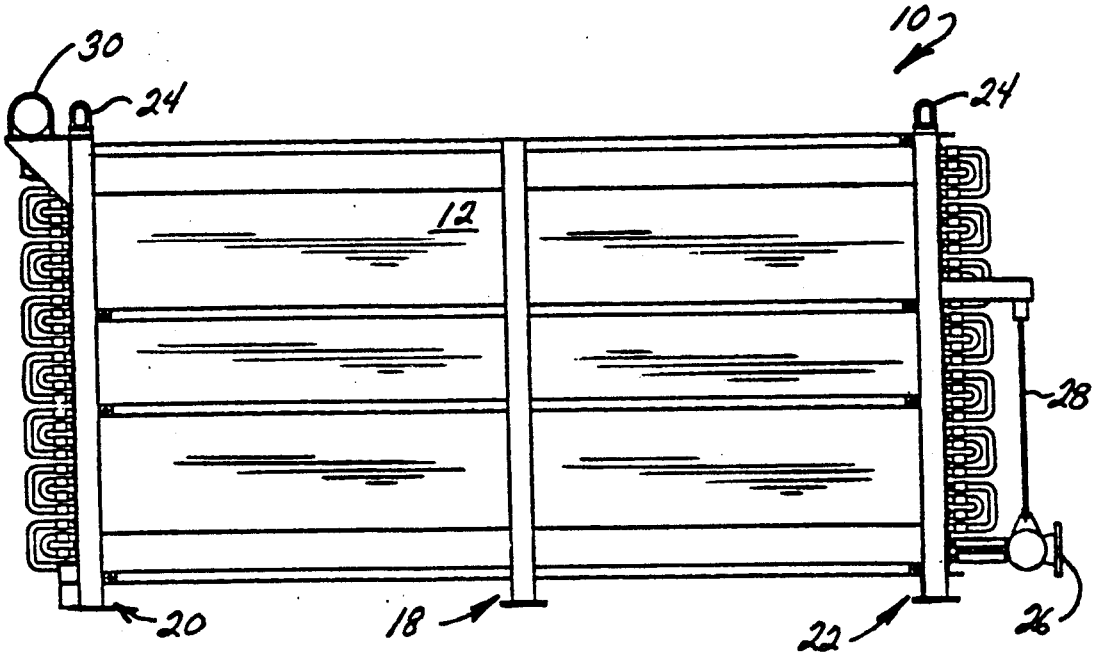
FIG. 1 is a side elevational view of a heat exchanger manufactured in accordance with the present invention.
Figure 2:
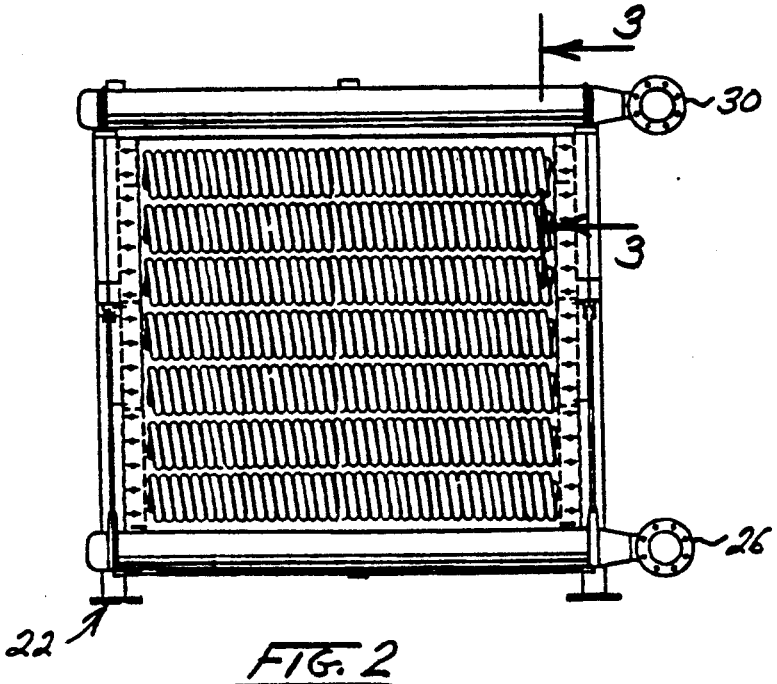
FIG. 2 is a side view of the heat exchanger depicted at FIG. 1.
Figure 3:
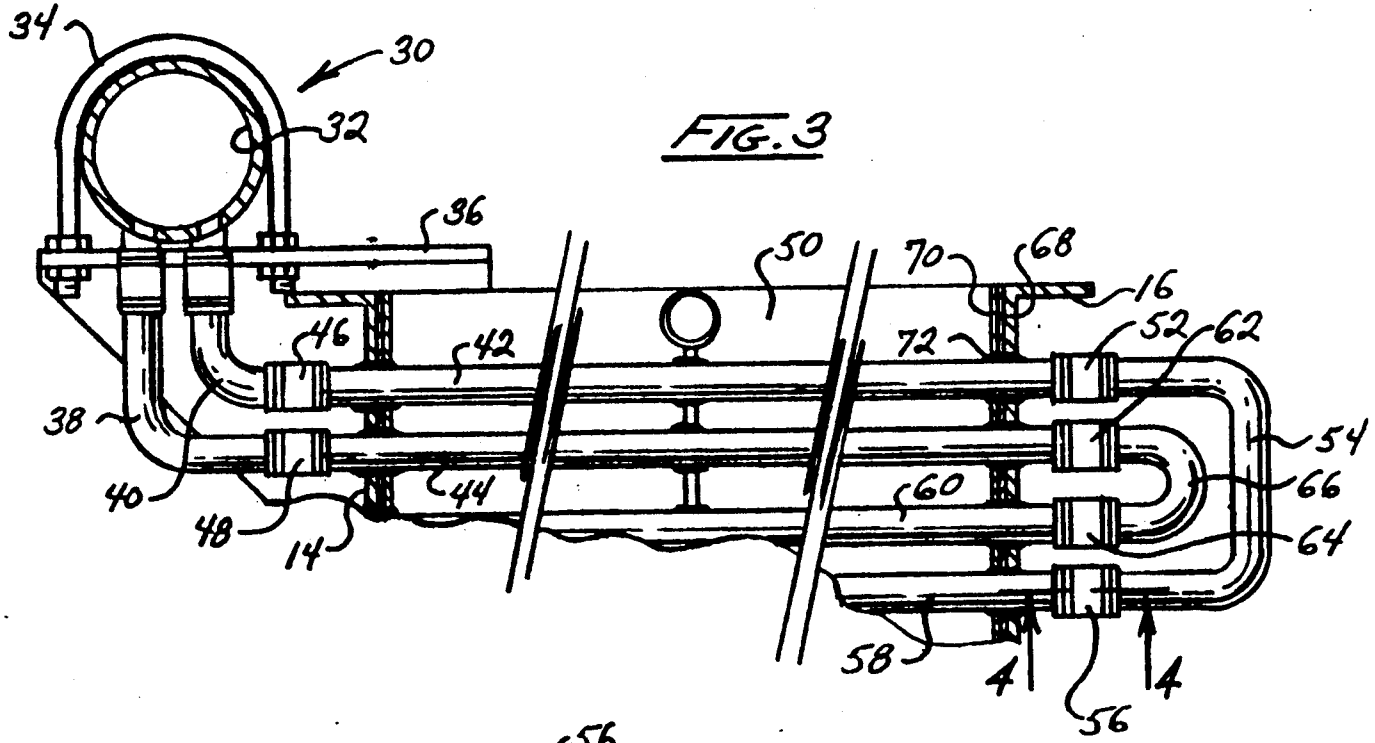
FIG. 3 is a cross-sectional view taken along line 3—3 of FIG. 2.

Referring initially to FIG. 1, heat exchanger 10 generally is formed from sidewall 12 and another parallel thereto which is not shown in the (drawings) side apertured tube sheets 14 and 16 (see FIG. 3). Central mounting assembly 18 and side mounting assemblies 20 and 22, along with similar mounting assemblies for the unshown sidewall permit the sidewalls and tube sheets to form an integral unit. Hoisting assemblies 24 and 26, along with similar assemblies associated with the unshown sidewall, permit heat exchanger 10 to be transported. Flue gas enters the top of heat exchanger 10 and exits via the bottom. Heat exchanger fluid enters heat exchanger 10 via inlet fluid header assembly 26 which is supported by eyerod hanger and adjustable pipe ring assembly 28. Heat exchanged fluid then is withdrawn from heat exchanger 10 via heat exchange outlet header assembly 30. The heat exchange tubes that are generally-horizontal in configuration are interconnected in alternating pairs of bi-layers (e.g. nests) via connector assemblies that will be described in detail below in connection with FIGS. 3 and 4. A variety of additional hardware is provided to complete the assembly of heat exchanger 10 into an integral unit as depicted at FIGS. 1 and 2, and is provided in conventional fashion as those skilled in this art will appreciate, e.g. water spray washing units for the tubes, etc.

With respect to FIG. 3, heat exchange fluid outlet header assembly 30 is seen to be composed of header 32 which is retained by U-bolt assembly 34 to mounting plate 36. Right angle connectors 38 and 40 admit heated heat exchange fluid from heat exchanger 10 into header 32. In turn, connectors 38 and 40, which preferably are manufactured from stainless steel, are connected to graphite tubes 42 and 44 via coupling assemblies 46 and 48. Tubes 42 and 44 penetrate through apertured side tube sheet 14 and thence through center tube sheet assembly 50, and terminate through side tube sheet assembly 16. In the piping configuration presently preferred, nests of four tubes have the inner pair connected and the outer pair connected as shown at FIG. 3. Other piping configurations can be used as is necessary, desirable, or convenient. In this regard, it will be observed that tube 42 passes through hose coupling 52 which connects tube 42 to connector 54 at one end, and hose coupling 56 which connects connector 54 to tube 58 at its other end. Tube 44 passes through apertured tube sheet 16 and is connected to tube 60 by hose assemblies 62 and 64 with intervening connector 66. This tube nesting connection arrangement then is repeated, for example seven times, as can be seen by reference to FIG. 2. Of course, a greater or lesser number of tubes and tube nests may be used as is necessary, desirable, or convenient. The invention will be described with reference to use of graphite tubes as impregnated graphite (phenolic/carbon impregnated) is the preferred material of choice presently. It will be appreciated, however, that other ceramic or ceramic-impregnated materials may be useful in forming tubes for use in accordance with the precepts of the present invention. These additional materials include, for example, other castable ceramics, metal and resin filled ceramics, metal matrix composites, silicon carbides, silicon carbide/ceramics and the like. Of course, use of various metals implies those that are resistent to corrosion or are covered by the corrosion-resistant constituent of the tube, by the acids contained in the contaminated gas streams subjected to condensing heat exchange utilizing such tubes.

Side tube sheet assemblies 14 and 16 have a unique bi-layer protection comprised of inner coating 68 formed from silicon carbide-impregnated epoxidized novolak that is cast/sprayed onto the surface of tube sheet 16, for example, and over which layer 70 is placed. Suitable novolaks for use as precursors are known in the art and typically are prepared by the reaction of formaldehyde with a hydroxyaromatic compound such as a phenol, cresol, or t-butyl phenol. The novolak then undergoes reaction with an epoxy reagent such as epichlorhydrin to produce the resin precursor. Various epoxidized novolaks are commercially available, and may be used in accordance with the invention. The silicon carbide content of the novolak epoxy generally ranges from about 5 to 40 percent by weight. Microfilled novolaks and even refilled novolak/epoxy systems could be used. Alternatively, coating 68 could be a ceramic or porcelain coating. Layer 70 is a sheet of fiber-reinforced fluoropolymer thermoplastic (i.e. fluoroelastomer), for example fiberglass-reinforced Viton elastomer (Viton elastomer is a vinylidene fluoride/hexafluoropropylene synthetic rubber, E. I. DuPont de Nemours and Company, Wilmington, Del.). Other reinforcing fibers could be used, including, for example, polymeric fibers, ceramic fibers, graphite fibers, and the like. The fiber reinforced fluoro-thermoplastic sheet is locked in place under compression by the tube sheet seals, such as typified by seal 72. Such seals preferably are those disclosed in commonly-assigned U.S. Pat. No. 4,738,310. Such bi-layer system has been found to provide improved corrosion-protection and erosion-resistance in protecting steel tube sheets.

Connectors 54 and 66 can be unenclosed and made from less expensive material than are tubes 42 and 44, for example, if an effective means for their interconnection is provided. Preferably, then, connectors 54 and 66 are made from stainless steel or other material that can be used to transport the heat exchange fluid passing therethrough, in terms of temperature, composition, and pressure. Stainless steel is used for resistance to oxygen corrosion that frequently results when cold (e.g. 50°–100° F.) water is heated, thus driving off dissolved oxygen. Since cold water often is the heat sink inside the tubes of a condensing economizer, it is required that the inside of the tubes and tube turns or connectors e.g. connectors 54 and 66) be resistant to oxidation or oxygen corrosion.

Figure 4:
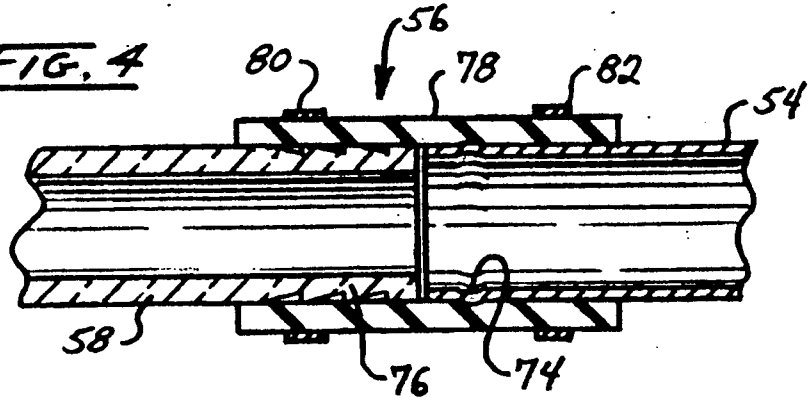
FIG. 4 is a cross-sectional view taken along line 4—4 of FIG. 3.

The thermal expansion characteristics of graphite and stainless steel, however, are quite different, thus making the direct connection via interfitting sleeves or the like impractical. Accordingly, a unique sealing system as depicted at FIG. 4 was developed. Referring to FIG. 4, it will be observed that tube connector 54 retains bead 74 adjacent its end. Graphite tube 58 contains a barbed or Christmas-tree fitting 76 about its end. The ends of tubes 54 and 58 are abutted, though not necessarily in tactile contact. In fact, a slight gap between the ends of tubes 54 and 58 permit expansion and contraction of these dissimilar materials individually and independently. In order to retain the heat exchange fluid passing under pressure therethrough, hose fitting 56 has been devised. Hose fitting 56 is composed of sleeve 78 which about its ends has clamps 80 and 82 attached. Sleeve 78 preferably is manufactured from molded silicon material or the like, preferably as an interior layer with an outer fiber-reinforced elastomeric coating being preferred. Molded silicon hose sleeves provide an effective seal when tubes 54 and 58 are press-fitted thereinto. Beads 74 and Christmas-tree fitting 76 provide effective engagement, along with couplings 80 and 82, so that an integral assembly has been created. In such configuration, such couplings have been pressure-tested to about 200 psi with water as the heat exchange fluid.

Since certain changes may be made in carrying out the above-disclosed invention and in the constructions set forth, without departing from the scope of the invention, it is intended that all matter contained herein or shown in the accompanying drawings shall be interpreted as illustrative and not in a limiting sense.

I claim:

1. A method for recovering heat from a gas stream contaminated with water vapor and acid or acid-forming moeity, said gas having an acid dew point ranging from about 200° F. to 300° F. and a water dew point ranging from about 90° F. to 150° F., which comprises:

passing said gas stream through a heat exchanger fitted with a plurality of generally-parallel tubes through which flow heat exchanging fluid countercurrent to the flow of said gas stream in said heat exchanger, the heat exchanging fluid being at a temperature such that the wall tube temperature or the temperature of said contaminated gas stream exiting said heat exchanger, is at or below either of said dew points, said tubes formed from acid-resistant ceramic material and exhibiting a smooth washable exterior surface; said exchanger fitted with a pair of side apertured tube sheets through which said tubes penetrate, the ends of said tubes being interconnected with connectors for establishing a flow path of heat-exchange fluid therethrough, between said tube sheets is an interior heat-exchange chamber through which said contaminated gas stream flows, said tube sheets being bi-layer lined with an inner epoxy novolac coating and an outer fiber-reinforced fluoroplastic layer.

2. The method of claim 1 wherein said gas stream passed through said heat exchanger comprises flue gas.

3. The method of claim 1 wherein said acid is selected from the group consisting of sulfuric acid, nitric acid, hydrochloric acid, carbonic acid, hydrofluoric acid, and mixtures thereof.

4. The method of claim 1 wherein said tubes comprise acid-resistant resin-impregnated graphite tubes.

5. The method of claim 4 wherein said ends of said tubes are interconnected with non-graphite connectors.

6. The method of claim 1 wherein said heat exchange fluid flowing through said tubes is selected from the group consisting of water and air.

7. The method of claim 1 wherein said inner coating comprises a silicon-carbide impregnated epoxy novolak coating.

8. The method of claim 1 wherein said fiber-reinforcement comprises glass fiber.

9. The method of claim 1 wherein said fluoroplastic layer is retained by sealing sleeves disposed in said apertures and through which said tubes pass.

10. The method of claim 1 wherein said fluoroplastic comprises an elastomer derived from the combination of vinylidene fluoride and hexafluoropropylene.

11. The method of claim 1 wherein said tube sheets are lined with an inner ceramic or porcelain coating and an outer fiber-reinforced fluoroelastomer layer.

12. The method of claim 5 wherein said non-graphite connectors are U-shaped and contain a bead about each end, each end of said graphite tubes contain a barbed fitting, an elastic sleeve is placed around the abutting of the connector and tube ends and which extends beyond the connector bead and tube barbed fitting, said sleeve having a pair of clamps pressed thereabout adjacent each end of said sleeve.

13. A method for recovering heat from a gas stream contaminated with water vapor and acid or acid-forming moeity, said gas having an acid dew point ranging from about 200° F. to 300° F. and a water dew point ranging from about 90° F. to 150° F., which comprises:

passing said gas stream through a heat exchanger fitted with a plurality of generally-parallel tubes through which flow heat exchanging fluid countercurrent to the flow of said gas stream in said heat exchanger, the heat exchanging fluid being at a temperature such that the exterior tube temperature or the temperature of said contaminated gas stream exiting said heat exchanger, is at or below both said dew points, each of said tube sheets being bi-layer lined with an inner silicon-carbide impregnated epoxy coating and an outer fiber-reinforced fluoroplastic layer.

14. The method of claim 13 wherein said fluoroplastic comprises an elastomer derived from the combination of vinylidene fluoride and hexafluoropropylene.

15. The method of claim 13 wherein said fiber-reinforcement comprises glass fiber.

16. The method of claim 13 wherein said fiber-reinforced fluoroplastic layer is retained in place by sealing sleeves disposed in said apertures and through which said tubes pass.

17. The method of claim 13 wherein said tubes are formed from acid-resistant ceramic material which exhibits a smooth washable exterior surface.

18. The method of claim 13 wherein said inner coating comprises a silicon-carbide impregnated epoxy novolak coating.

19. The method of claim 13 wherein said tubes comprise acid-resistant resin-impregnated graphite tubes.

20. A method for recovering heat from a gas stream contaminated with water vapor and acid or acid-forming moiety, said gas having an acid dew point ranging from about 200° F. to 300° F. and a water dew point ranging from about 90° F. to 150° F., which comprises:

passing said gas stream through a heat exchanger fitted with a plurality of generally-parallel tubes through which flow heat exchanging fluid countercurrent to the flow of said gas stream in said heat exhanger, the heat exchanging fluid being at a temperature such that the wall tube temperature or the temperature of said contaminated gas stream exiting said heat exchanger, is at or below both either of said dew points, said tubes formed from acid-resistant ceramic material and exhibiting a smooth washable exterior surface; said exchanger fitted with a pair of side apertured tube sheets through which said tubes penetrate, the ends of said tubes being interconnected with connectors for establishing a flow path of heat-exchange fluid therethrough, between said tube sheets is an interior heat-exchange chamber through which said contaminated gas stream flows, said tube sheets being bi-layer lined with an inner ceramic or porcelain coating and an outer fiber-reinced fluoroelastic layer.

* * * * *